United States Patent [19]

Cleland

[11] Patent Number: 4,714,002

[45] Date of Patent: Dec. 22, 1987

[54] PERCUSSION MUSICAL INSTRUMENT DRUM-HEAD SKIN TENSIONING ASSEMBLY AND DRUM SHELL CONSTRUCTION THEREFOR

[76] Inventor: Terry P. Cleland, 1769 Woodview Avenue, Pickering, Ontario, Canada

[21] Appl. No.: 838,328

[22] Filed: Mar. 11, 1986

[30] Foreign Application Priority Data

Mar. 13, 1985 [CA] Canada ..... 476373

[51] Int. Cl.[4] ..... G10D 13/02

[52] U.S. Cl. ..... 84/413; 84/416

[58] Field of Search ..... 84/411 R, 411 A, 411 M, 84/411 P, 412, 413, 414, 415, 416, 417, 418, 419, 420, 421

[56] References Cited

U.S. PATENT DOCUMENTS 3,435,723 4/1969 Corder ..... 84/411

3,981,220 9/1976 Clark ..... 84/415

FOREIGN PATENT DOCUMENTS 2150732 7/1985 United Kingdom ..... 84/413

*Primary Examiner*—L. T. Hix

*Assistant Examiner*—Brian W. Brown

*Attorney, Agent, or Firm*—K. Maxwell Hill

[57] ABSTRACT

One of a pair of concentric ring hoops overlaps the other and holds the perimeter edge of a drum head vibratile element in tension between the mating overlapping faces of the hoops. The hoops are held together by a tensioning bolt threadable into a bracket connected to a lower hoop which has another skin stretched between a stepped inner annular groove on its inner face edge. A drum shell made of a composite of rigid foam interior spaced apart by a pair of epoxy impregnated carbon fibresheets is held by the lower second drum skin into enclosing engagement on its upper perimeter edge with an inner stop flange and vertical wall face of the inner hoop ring of the drum head vibratile skin assembly.

1 Claim, 4 Drawing Figures

PERCUSSION MUSICAL INSTRUMENT DRUM-HEAD SKIN TENSIONING ASSEMBLY AND DRUM SHELL CONSTRUCTION THEREFOR

FIELD OF INVENTION

The present invention relates to musical drum construction for use with marching bands. In particular the invention herein provides a means of constructing a drum-head skin tensioning assembly and a drum shell for use therewith, wherein light-weight materials are used and wherein the skin tensioning means do not bear on the drum shell walls to damage or distort them while percussive sounds are produced therewith.

BACKGROUND OF THE INVENTION

It is known that when animal skins or organic materials are used for the vibratile element in a musical drum, the skin tensioning means for the drum head must be adjusted for moisture and temperature variations and that there are limits to which the skin can be stretched without destroying the fabric of the vibratile element. As a result new and better materials have been devised that are superior to natural fibers. The most recent have been the use of glass fibres in a resin matte and most notably the use of a woven cloth of KEVLAR (trade mark). These new materials can be subjected to much greater tensions than former skin materials and therefore superior vibration sounds can be produced but when greater tension assemblies are made the drum shells can fail or the natural weaknesses therein can appear to distort the drum and resulting musical effect. It is also known that the drum-head tensioning devices are connected and held in place by bushings and the like attached to the drum shell. To accept the increased tension the drum shell must be increased in strength and therefore in weight. Where wood is used as a shell the increase in size and weight becomes a problem that results in the use of metal for the drum shell. Drums now used for marching bands have reached a weight that has become objectionable to marching drummers and there is now a need for a light weight drum that has a synthetic drum-skin that can withstand high tension and a drum shell free from the reaction forces of the tension assembly.

OBJECTS OF THE INVENTION

The principal object of the invention is to provide a means for tensioning a drum skin which does not require either direct or indirect attachment through the drum shell wall and where the upper skin can be tensioned independantly from the lower skin. Another object of the invention is to provide a light weight drum for marching bands while increasing the strength of the components by manufacturing them from carbon fibre matts. A further object of the invention is to provide a drum shell composed of a cylindrical shell having an inner and outer wall of carbon fibre matte or woven carbon fibres spaced apart by KLEGECELL (trademark) foam or other known rigid foam material. A still further object of the invention is to provide a drum skin tensioning assembly having a drum shell upper side and perimeter of cylindrical configuration but having a bottom side of variable shape such as open, spherical or otherdesired shape.

SUMMARY OF THE INVENTION

The invention herein of a drum-head skin tensioning assembly is composed essentially of two concentric rings for the top of the drum and one hoop or ring for the bottom side of a cylindrical drum. The upper assembly of rings comprises inner and an outer rings, the outer ring overlaps the inner ring and the outer ring is identical in configuration to the drum bottom ring and is attachable to it by a tensioning assembly of bracket members spaced apart around the ring to overlie the outside of a drum shell. The drum shell is held between the outer rings by a stop or step in the rings into which the drum shell abutts when the assembly is drawn together by the tensioning means of the brackets.

The inner ring of the drum-head skin tensioning assembly is L-shaped in cross section and is comprised of a vertical flange an outwardly directed foot-flange and an inwardly directed drum stop flange extending from the upper edge of the vertical flange. The outer ring overlaps the upper portion of the inner hoop ring and the drum skin and vibratile element is secured to be stretched between the overlapping edges of the rings. The vibratile percussive element or skin is secured around its perimiter edges by a slot in a hoop which in turn is held against an annular step cut into the lower inside edge of the outer ring. Forcing the rings together varies the overlap and thereby varies the degree of downward force on the skin stretched between the rings.

IN THE DRAWINGS

With the foregoing objects in view and such other objects that become apparent from consideration of this disclosure the present invention consists of the novel concept which is comprised, embodied and included in the structure and method exemplified, reference being had to the accompanying drawings in which like reference numerals refer to like parts.

DESCRIPTION OF THE PREFERRED EMBODIMENT OF THE INVENTION

Figure 1:
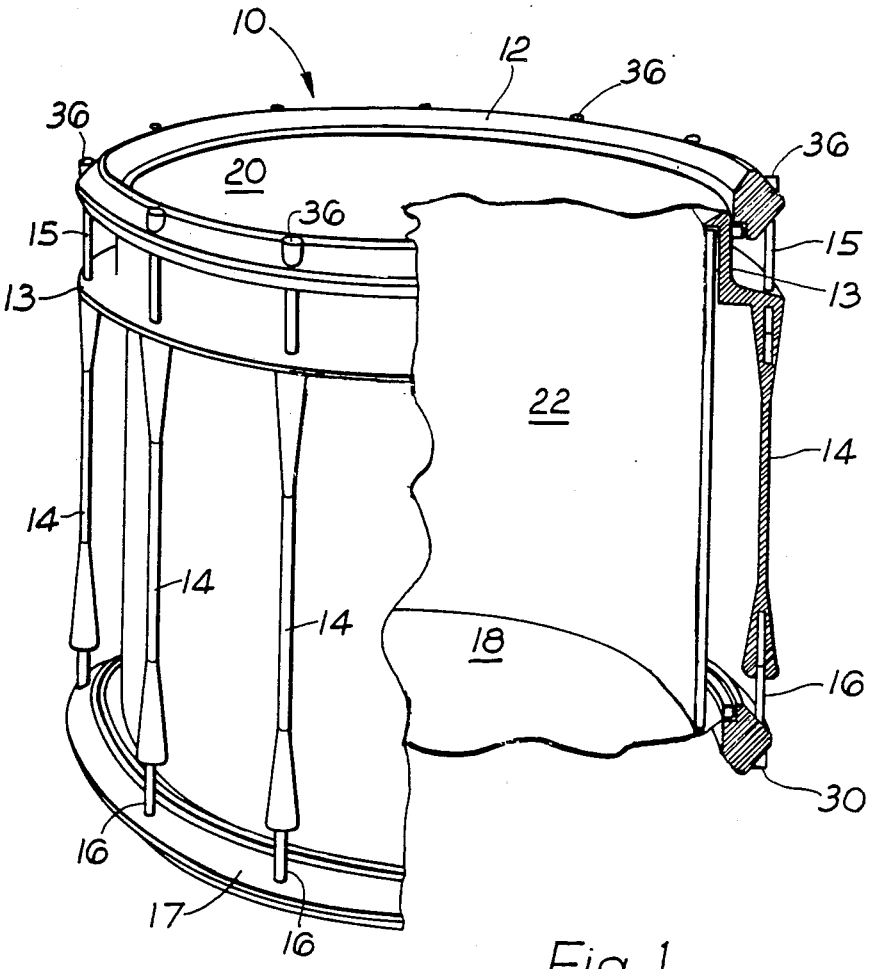
FIG. 1 is a perspective view of a musical drum as used by marching bands and is shown cut away in part to show in cross section the tensioning means and drum-head assembly of the invention.
Figure 2:
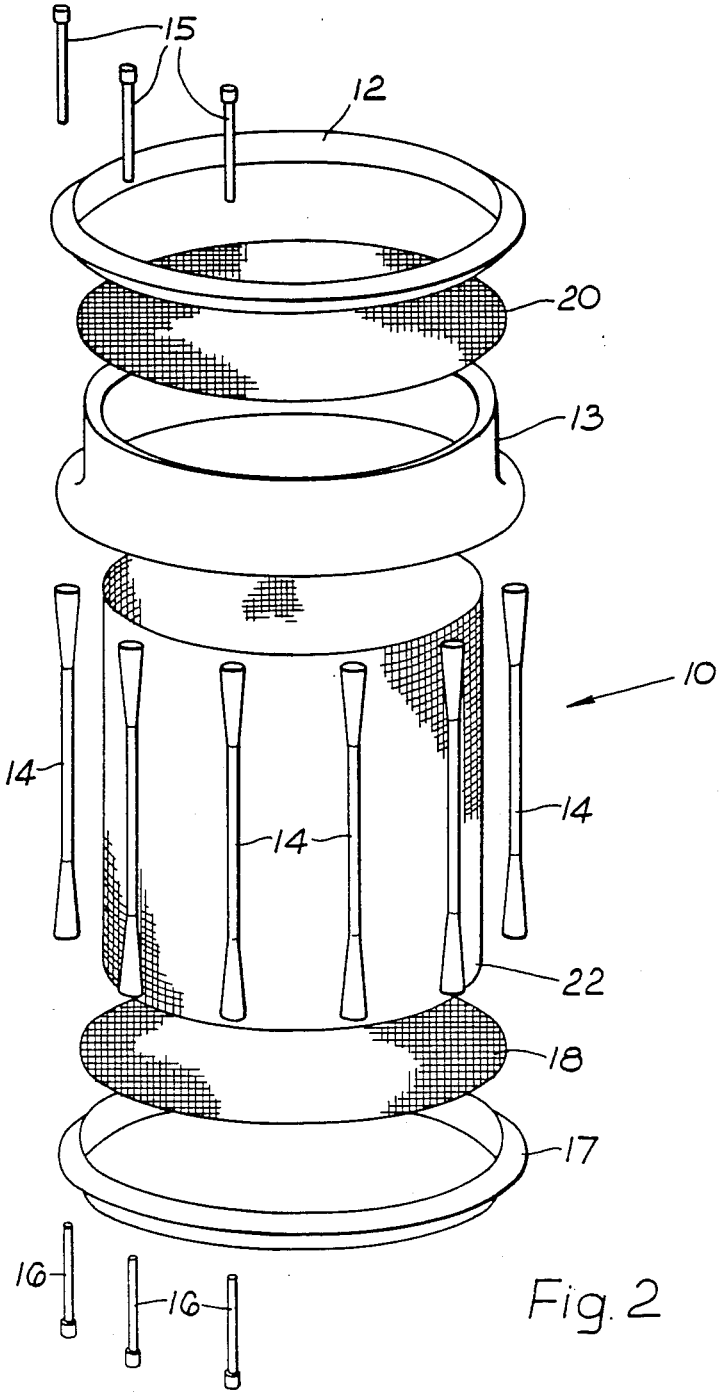
FIG. 2 is an exploded view of the drum showing the component parts thereof.
Figure 3:
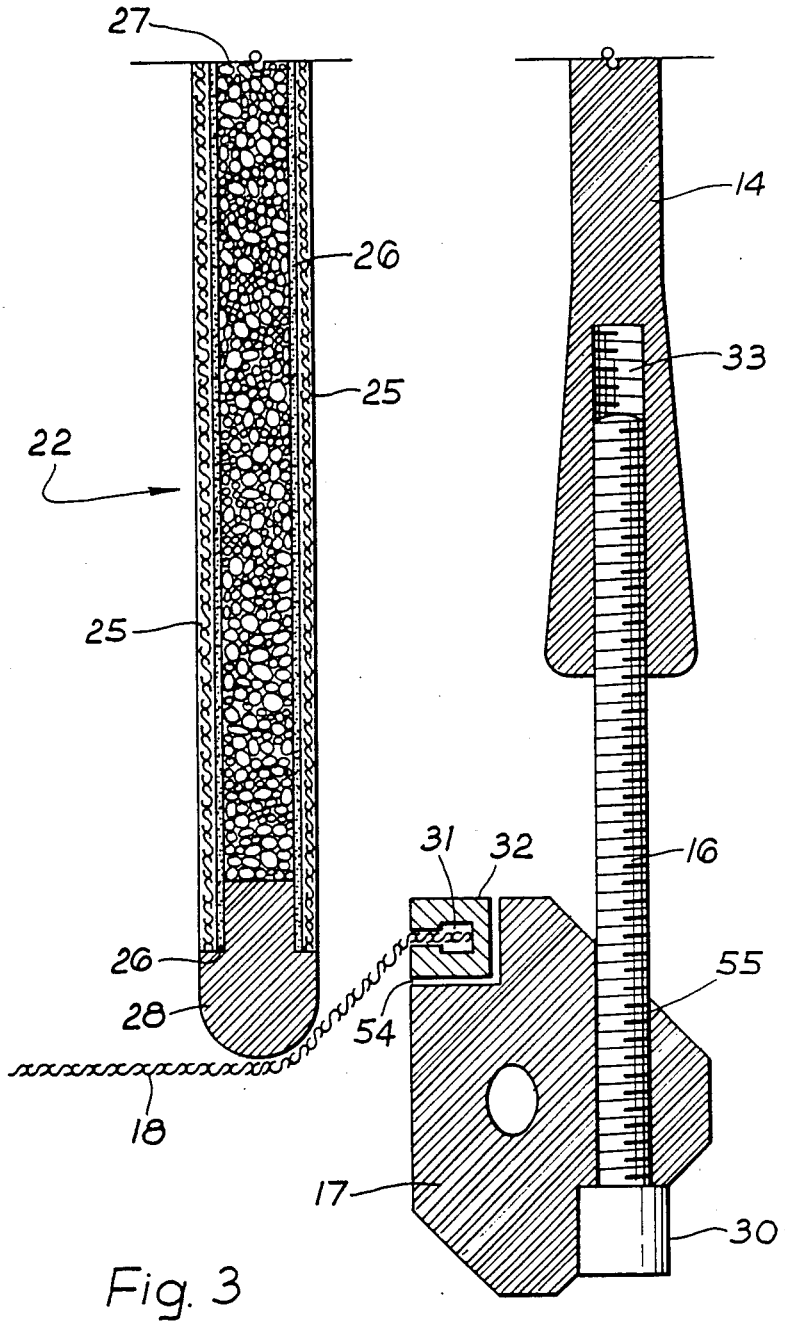
FIG. 3 is a sectional view taken through the bottom half of the cross-section portion of the view of FIG. 1.
Figure 4:
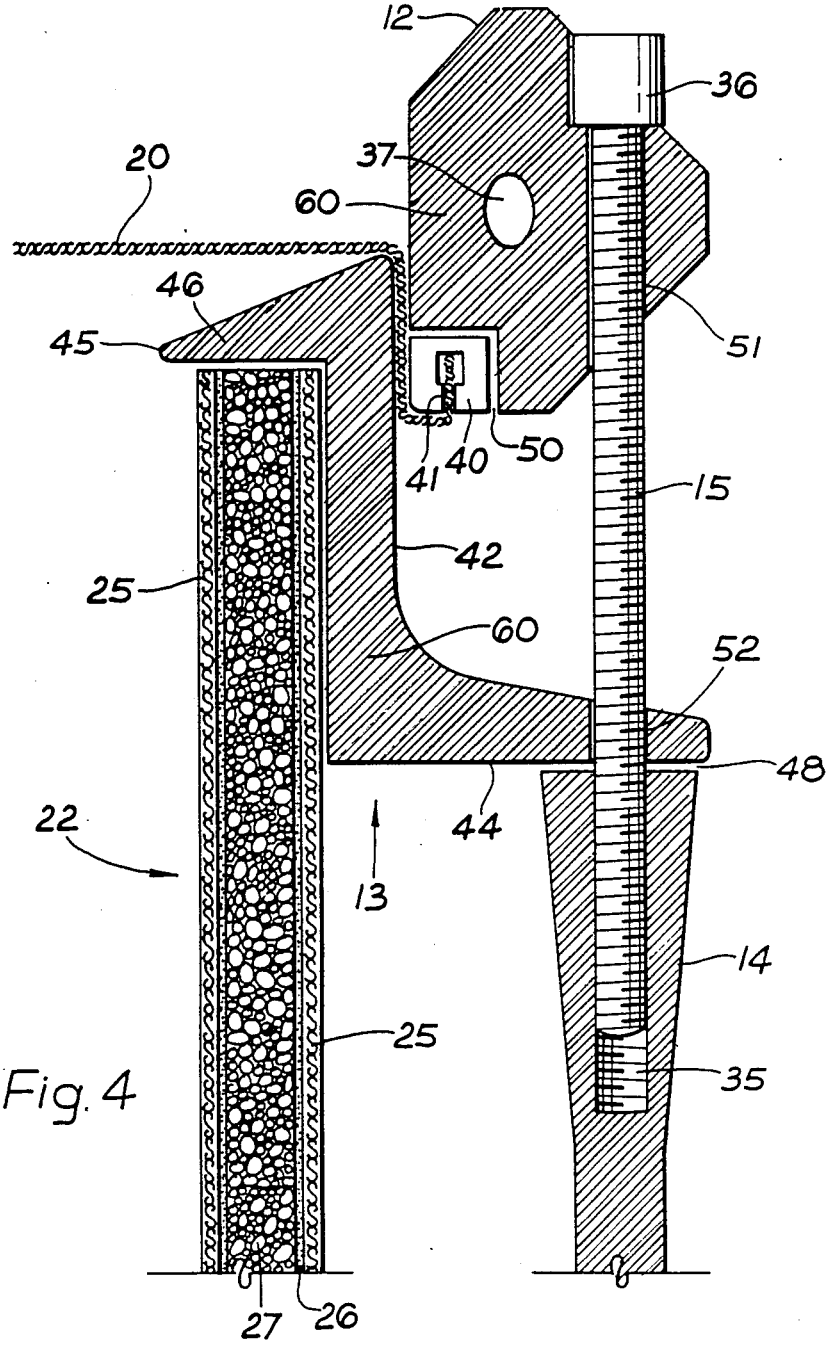
FIG. 4 is a sectional view of the essential components of the invention taken and enlarged of the upper portion of the cross section of the partially cut away view of FIG. 1.

In the drawings numeral 10 indicates the drum-head skin tensioning assembly and comprises a pair of hoop rings 12 and 13. A drum-head skin 20 of KELVAR (trademark) or other woven material having high tensile strength, is secured by its perimeter edge into a slot in a hoop 40 (FIG. 4). Ring 12 overlaps ring 13 and ring 12 has a step 50 cut in an annular form in its lower inner corner to accomadate the locking hoop 40.

Adjustable threadable screw bolts 15 are provided to maintain rings 12 and 13 in a fixed overlapping relationship with one another and with the stretched skin 20 therebetween. The stretching tension on the skin 20 by way of the overlapping rings 12,13, is achieved by the screwing of bracket rod 14 onto the threads of bolt 15 as held by cap heads 36 against the upper side of ring 12, and as held against face 48 of the foot flange 44 or inner ring 13. Apertures 51 and 52 are provided to pass through rings 12, 13, and apertures are made in a lower ring 17 in a position such that when the drum is assembled the apertures 51,52,55, align parallel to the axis of the drum shell 22. A screw bolt 16 is freely inserted through aperture 55 of loop 17 which is lower ring identical in configuation to upper ring 12. The drum assembly is put together with bolt bracket rod 14 threaded onto bolt 15 with skin 20 held in slot 41 of hoop 40 abutting hoop 12 in step 50 and with the bolt 15 freely passed through aperture 52 Of flange 44 of hoop 13. With drum shell duly fitted down into the embrace of the inner side of vertical flange 42 of ring 13 and pressed down to abut stop flange 46 at annular face 45 the lower assembly of bolt threaded into bracket 14 after passing through aperture 55 of lower hoop 17 duly holding in step 54 a hoop 32 gripping at 31 a tensioned bottom skin 18 which maintains the drum shell 22 in abutting engagement with the stop 46 of hoop 13 by the skin pressure of the vibratile element 18 against plug 26 fitted to the bottom of the shell 22. After all the components are assembled with the bolts 15 securely threaded into the upper parts of the brackets 14 by thread means 35 and the bottom bolts 16 secured to the bottom threads 33 of brackets 14 the top and bottom vibratile skins 20,18, can be independently tensioned by means of cap screws 36 for the top of bolts 15 and cap screws 30 for the lower bolts 16.

The alignment of the bolts 15,16 through the apertures 51,52,55, and the adjustment of bolt 15 with bracket 14 until bracket 14 abuts against flange 44 at 48 to hole drum head assembly 10 together and the adjustment of bolts 16 into bracket 14 to provide sufficient tension on skin 18 to maintain the drum shell 22 into fast engagement with the inner ring 13 of the drum head assembly is the first or initial tensioning of the drum skins. The fine adjustments for the drum skins is done independently by means of the cap screws 36,35 as follows; Allen wrench tools are employed to adjust each of the plurality of cap screw heads 36 which are threadable on the rods 15 and each of caps 36 bear in a socket in an annular spaced apart pattern on the upper side of ring hoop 12. The screwing down of caps 36 against ring 12 forces down ring 12 against the skin 20 as held in slot 41 of hoop ring 40 held in groove or step 50 of ring 12. The skin 20 is held by a uniform area of overlap of the mating of the inner surface of ring 12 on the outer surface of the vertical flange 42 of inner ring 13.

When the vibratile element 20 is made from KEVLAR (trademark) woven fabric a very great tension can be applied to it by the tension system herein to create new sounds in the art not heretofore known. When known metallic hoops 12 of the old flange type were used with the assembly shown so great a tension was applied by the fine tuning of the caps in series around the ring that the flanges of the ring collapsed. Accordingly a shape as shown in the drawings herein was devised to withstand the buckling forces created as the skin was tensioned and the overlap increased between rings 13,12. However as the hoop rings 12,13 were made from metal, the increase of the bulk size of ring 12 added unwanted weight to the drum which was found to be unacceptable to marching drummers. To decrease weight while at the same time to increase the strength of the ring 12 it was found that a shape as shown made from carbon fibres impregnated with epoxy resin served both ends most satisfactorily. The weight of the drum was further reduced and the strength and appearance increased by constructing all of the three stressed components 12,13, and 14 of carbon fibres pressed in a mold with epoxy resins 60.

37 indicates the residual space that is created when certain techniques of moulding are employed and allows less material to be used in places where no strength is required at at 37.

The drum skin 18 held in the hoop 32 at slot 31 serves to maintain the drum shell 22 in engagement with the stop flange 46 of ring 13, when bottom ring 17 is held in position by the bolt in bracket 14 and step cut 54 on the inner upper edge of ring 17 keeps the skin hoop 32 securely in place. The drum shell therefore needs no fixed attachment to the assembly 10 and as a consequence the tremendous increase in tension forces created at the assembly 10 by the tensioning of the caps 36 are not transferred to the drum shell 22. The drum shell can be made from much less distortable material. In the prior art the fastening of the tensioning brackets to the drum shell required the use of heavier drum shells resulting in heavy drums. The drum shell of the present invention need only withstand the tensioning pressures caused by the adjustment of screw caps 30 and as skin 18 does not require to be stretched to the great extent as does the vibratile element of skin 20, shell 22 need only be made to withstand the tensions imposed upon it by the stretching of skin 18. In the result, the novel tensioning assembly of drum head 10 has allowed the use of much lighter weight material to be used in drum shells. In the present invention the optimum strength to weight ratio of shell has been created. A sheet of woven carbon fibres 25 has been attached by suitable epoxy resin glues to a thin layer of rigid foam such as is commercially sold under the name KLEGECELL (trademark), and set within a cylindrical mould. The epoxy is enumerated 26 in the drawing and the foam 27. The resulting shell after being taken from the mould has a NYLON or plastic plug fitted to the bottom as shown at 28 where it bears on the edge of the carbon fibre sheets 25 and the spacer foam material 27. The shell 22 made as above described has negligible weight in comparison to the heavy plywood, glass fibre or metal drum shells now required to withstand the tensioning mechanisms attached thereto.

What I claim is:

1. A drum head skin tensioning assembly comprising in combination;

inner and outer hoop rings, said inner ring being essentially L-shaped in cross sectional view and comprised of a vertical flange, an outwardly directed foot-flange and an inwardly directed drum stop flange on the upper edge of said vertical flange, said outer ring overlapping the upper portion of said inner hoop ring;

an annular step formed in the lower inner edge of said outer ring to accommodate a locking hoop, said drum skin being secured between said locking hoop and said annular step;

means co-acting with said rings for varying the tension of said skin by varying the extent of overlap between said rings;

a drum shell, said inwardly directed stop flange being adapted to abut an upper perimeter edge of said drum shell;

said inwardly directed drumstop flange being held in abutment with the upper perimeter of said drum shell by the tensioning means being secured to a second outer hoop ring adapted to maintain another drum skin in abutting force against a lower perimeter edge of said drum shell, said drum shell being of cylindrical configuration;

a tension varying means in the form of a set of aligned apertures in said outer ring of said foot flange, and threadable cap screws extending through said set of apertures for torquing down the assembly in overlapping position after the drum has been set in abutment with the inner ring stop flange and the second upper hoop has been tensioned to mate with the lower drum head skin against the lower part of the drum shell perimeter edge;

said drum shell being composed of a cylinder made from a sheet of rigid foam spaced between and attached by epoxy cement to sheets of woven carbon fibres overlying both sides of said rigid foam sheet and abutting together along a line in a mould to provide a cylindrical shape when said line is fastened together by an epoxy cement seam.

* * * * *